US008161866B2

(12) United States Patent
Kollep et al.

(10) Patent No.: US 8,161,866 B2
(45) Date of Patent: Apr. 24, 2012

(54) CAPSULE FOR PREPARATION OF A BEVERAGE WITH A SEALING MEMBER ATTACHED THERETO AND METHOD OF PRODUCING THE SAME

(75) Inventors: Alexandre Kollep, Lutry (CH); Daniel Abegglen, Rances (CH); Thomas Kaeser, Brent VD (CH); Heinz Leuthold, Einsiedeln (CH); Reinhard Lutz, Höchst (AT)

(73) Assignee: Nestec S.A., Vevey (CH)

( * ) Notice: Subject to any disclaimer, the term of this patent is extended or adjusted under 35 U.S.C. 154(b) by 702 days.

(21) Appl. No.: 12/298,132

(22) PCT Filed: Apr. 23, 2007

(86) PCT No.: PCT/EP2007/053918

§ 371 (c)(1),
(2), (4) Date: Mar. 23, 2009

(87) PCT Pub. No.: WO2007/122206

PCT Pub. Date: Nov. 1, 2007

(65) Prior Publication Data

US 2009/0223373 A1 Sep. 10, 2009

(30) Foreign Application Priority Data

Apr. 24, 2006 (EP) ..... 06112976

(51) Int. Cl.
*A47J 31/00* (2006.01)
*A23F 5/00* (2006.01)
*B65B 29/02* (2006.01)

(52) U.S. Cl. ..... 99/279; 99/295; 426/77; 426/112; 426/433

(58) Field of Classification Search ..... 99/295, 99/302 R, 297; 426/77, 84, 112, 431, 433
See application file for complete search history.

(56) References Cited

U.S. PATENT DOCUMENTS

| | | | | |
|---|---|---|---|---|
| 4,136,202 | A | 1/1979 | Favre | 426/77 |
| 5,656,316 | A * | 8/1997 | Fond et al. | 426/433 |
| 5,897,899 | A * | 4/1999 | Fond | 426/112 |
| 7,926,415 | B2 * | 4/2011 | Yoakim et al. | 99/295 |
| 7,993,691 | B2 * | 8/2011 | Yoakim et al. | 426/77 |
| 2003/0217643 | A1 | 11/2003 | Masek et al. | 99/279 |

FOREIGN PATENT DOCUMENTS

| | | |
|---|---|---|
| AU | 515875 | 5/1981 |
| EP | 512 470 | 11/1992 |
| EP | 554 469 | 8/1993 |
| EP | 1 471 012 | 10/2004 |
| JP | 53076171 | 7/1978 |
| JP | 2004525829 | 8/2004 |

* cited by examiner

OTHER PUBLICATIONS

International Search Report PCT/EP2007/053918 Dated Jun. 12, 2007 and Written Opinion.

*Primary Examiner* — Nini Legesse
(74) *Attorney, Agent, or Firm* — Winston & Strawn LLP

(57) ABSTRACT

A method for producing a capsule containing beverage ingredients designed for insertion in a beverage production device in which a liquid under pressure enters the capsule in order to interact with the ingredients in the capsule and to form beverage. The method includes preforming the capsule body and at least a portion of said flange-like rim, placing a premade sealing member on the flange-like rim, crimping a portion of the flange-like rim on a portion of the sealing member so resulting in the sealing member becoming attached to the flange-like rim.

18 Claims, 14 Drawing Sheets

CAPSULE FOR PREPARATION OF A BEVERAGE WITH A SEALING MEMBER ATTACHED THERETO AND METHOD OF PRODUCING THE SAME

This application is a 371 filing of International Patent Application PCT/EP2007/053918 filed Apr. 23, 2007.

BACKGROUND

The present invention generally relates to capsules for containing beverage ingredients to a beverage producing system for use in connection with such capsules as well as to methods for producing such capsules.

The background of the present invention is the field of capsules which contain beverage ingredients (e.g., coffee ground, milk powder) or other comestible ingredients (e.g. dehydrated soup). By means of an interaction of these ingredients with a liquid, a beverage or other comestibles can be produced. The interaction can be for example an extraction, brewing or dissolution process. Such a capsule is particularly adapted to contain ground coffee in order to produce a coffee beverage by having hot water under pressure enter the capsule and draining a coffee beverage from the capsule.

Systems and methods for obtaining fluid comestibles from substances containing capsules are for example known from EP-A-512470.

The general principle of this extraction process can be summarized as follows:

- An initially closed capsule is inserted between capsule holder means which are closed in a watertight manner about the capsule;
- Water injection means of the machine inject water in the capsule;
- Water interacts with the ingredients contained in the capsule while traversing the interior of the capsule and is then made to leave the capsule through at least one opening/perforation created in the second wall.

The ingredients in the capsule constitute the "bottleneck" of the flow path of the water and will therefore cause a pressure drop between the upstream and the downstream side of the liquid flow through the capsule, which pressure drop will even increase during the interaction between the liquid and the ingredients for example due to a swelling of the ingredients. Correspondingly it has to be assured that the only water flow is actually taking place through the interior of the capsule and that no water can flow from the water injector. In other words, any water flow exterior to the capsule has to be stopped by a sealing engagement being positioned between the annular enclosing member of the holder means and the capsule and in the flow path between the water injector and the beverage-draining bore.

Such sealing engagement can be achieved at least to a certain degree by the pinching engagement between the capsule holder means (i.e., annular enclosing member and capsule holder) and the flange-like rim of the body inbetween.

In case the sealing engagement is not working properly and water is flowing outside the capsule, no pressure sufficient to cause the tearing of the tear face will be built up inside the capsule or, alternatively, the pressure will be causing no complete tearing of the tear face and therefore a poor extraction of the substance. In such a scenario water will be drained from the beverage production device without having interacted or fully interacted under sufficient pressure conditions, with the ingredients contained in the capsule.

An improvement could be thought of according to which this sealing engagement is further improved by lining the inner wall of the annular member with a rubber-elastic material. In other words, according to said approach the sealing engagement is assured by structures fixed to or attached with the beverage-producing device. This has disadvantages in that after the use of a substantial number of capsules a wearing off of the fixed sealing means can take place such that the quality of the produced beverage is increasingly deteriorated by water passing the no longer properly efficient sealing. Furthermore, the sealing means can become dirty with organic residues sticking to it which is not very hygienic and may affect the sealing and pressure conditions as well during extraction.

Any "leak" at the exterior of the capsule reduces the pressure build-up inside the capsule. On the other hand, it is well known that a sufficient extraction pressure is a key factor for the quality of espresso-style coffee.

European co-pending patent application No. 04025320.5 entitled "Capsule with sealing means" aims at an improvement of the sealing engagement positioned between the liquid inlet and the beverage draining side of such a beverage production system. The invention aims at transferring a resilient part of the sealing engagement from the beverage production device to the capsule. The advantage is that any resilient sealing member is only used once (i.e. only with the associated capsule) such that a proper functioning of the sealing can be assured and no hygienic problems can occur at the sealing member.

The present invention aims at another improvement of European co-pending patent application No. 04025320.5 in order to improve the sealing conditions between the capsule and the sealing member so to ensure watertightness during brewing. Indeed, it is of importance to avoid any potential liquid leakage between the sealing member and the rest of the capsule in particular by creating a good bond between the two.

Furthermore, it is also of importance that the sealing member is integrated to the capsule using a process that can be implemented on a large industrial scale, be highly reliable with minimal defective products and be also cost effective.

SUMMARY OF THE INVENTION

The object is achieved by means of the features of the independent claims. The depending claims further develop the central idea of the present invention.

For this, the method of the invention is for producing a capsule containing beverage ingredients designed for insertion in a beverage production device in which a liquid under pressure enters the capsule in order to interact with the ingredients in the capsule and to drain a beverage from the capsule. The capsule member comprises a body extending by a flange-like rim with a sealing member attached thereto.

The method comprises:

- preforming the capsule body and at least a portion of said flange-like rim,
- placing a premade sealing member on the flange-like rim,
- crimping a portion of the flange-like rim on a portion to the sealing member so resulting in the sealing member becoming attached to the flange-like rim.

In other words, the method aims at an application process of the sealing member which uses crimping of the flange-like rim of the capsule's body to create a tight application of the sealing member on the capsule, in particular, on the flange-like rim of the capsule.

More particularly, the crimping operation comprises forming a curled end at the flange-like rim arranged to pinch a portion of said sealing member. Due to the resulting curled configuration of the attachment and pinching of a portion of the sealing member, liquid leakage can be prevented between the sealing member and the capsule's body and the conditions of extractions can be better guaranteed and maintained from capsule to capsule (i.e., Better repeatability of the brewing conditions).

The sealing member can have a general ring-shaped form. The sealing member can so be placed about the body of the capsule and at the flange-like rim using a guiding mandrel, for instance, that pushes the sealing member and applies it in contact with the flange-like rim.

In particular, the sealing member can comprise a sealing portion and a connection portion extending outwardly from the sealing portion; wherein the connection portion is pinched by crimping a portion of the curled end of the flange-like rim. The sealing portion is the portion which is intended to be deformed or compressed by a pressing surface of the production device and/or by the pressurized fluid against a surface of the production device to create a fluid tight sealing arrangement downstream of the capsule enclosure of the device during brewing.

According to a mode of the method of the invention, during preforming of the capsule's body, an open curled end or, alternatively, a substantially closed curled end is already preformed. A substantially closed curled end provides the advantage of facilitating handling of the capsules' bodies, transporting from the preforming station to the seal application station and storing. An open curled end of the body's rim can provide the advantage of a stronger connection with the sealing member by rolling up a portion of it as well as pinch it tight.

Therefore, in the crimping operation, the curled end can be finally further curled or at least be pressed sufficiently to pinch the sealing member tight.

In a possible mode, the sealing member is pinched by the outer surface of the folded or curled end of the flange-like rim. As a result, a good bond is created along a large surface while not cutting or damaging the sealing member.

Furthermore, during forming of the curled end, a portion of said pre-curled end is pressed to at least partially close the annular opening and so to pinch the connection portion of the sealing member.

In a possible aspect, the section of the connection portion of the sealing member is made relatively thinner than the larger section of the sealing portion of the sealing member. The thinner section enables to create a relatively small crimped curled end with the sealing member being properly affixed thereto. The comparatively thicker portion of the sealing member ensures a sufficient thickness of sealing material to be able to compensate for or to correctly fill in the clearance, gap or irregularities by closing of the production device and/or by effect of the fluid pressure acting on the sealing member. In particular, a sufficient volume of sealing material may be needed to be deformed under the pressure exerted by the pressurized fluid and be compressed or otherwise deformed against surfaces of both the enclosing member of the device and the capsule's surface to form a liquid tight seal arrangement.

In a possible mode, the sealing member is premade with a sealing portion and a connection portion being relatively aligned one another and during crimping the curled end is further curled or at least flattened to crimp the connection portion along an external surface of the curled end.

In another mode, the sealing member is premade with a connection portion being inclined downwardly relative to the sealing portion and during crimping, a curled end is further curled to straighten the connection portion out, eventually roll it up, and pinch it.

Furthermore, the sealing member can comprise an annular extension portion that extends beyond the flange-like rim along the side of the capsule's body. The body can have a trunconical or cylindrical shape, for instance. The extension portion ensures a higher surface of contact between the sealing member and the surface of the capsule's body and higher volume of sealing material thereby it improves the fluid-tight arrangement but also ensures a closer fitting of the sealing member with the capsule.

The method of the invention also contemplates preforming the capsule's body by deep-drawing of a metal or metal-plastic sheet. The capsule body can be deep drawn during one step or sequential steps to form a final main open cavity enabling filling of the food ingredients. During this deep-drawing step(s), the pre-curled portion can be formed. The pre-curled portion may also be formed after the deep-drawing of the cavity of the body in a subsequent step.

In another subsequent step, the body is filled with the food ingredient such as roast and ground coffee.

The capsule body can comprise aluminium. It can be a single ply of aluminium or a multi-ply of plastic and aluminium such as polypropylene and aluminium, polyethylene-aluminium or polylactic acid-aluminium.

Of course, the sealing member can be attached to the capsule's body by additional connection means in order to improve even more the contact with the sealing member and prevent any risk of leakage, as well as improve the visual appearance and reduce the risk of defective capsules. For instance, it comprises an additional step of gluing or welding the sealing member at the flange-like rim. The sealing member can be attached to the capsule using an adhesive or by (thermal or ultrasonic) welding.

In another subsequent step following the food ingredient filling step, welding a membrane is carried out along a portion of the external face of the flange-like rim to close the capsule and maintain longer freshness of the food ingredients.

The sealing member can be of a resilient material. Preferably, the sealing member is of rubber-elastomer, plastic-elastomer, plastic or silicone material.

The present invention can also relate to a capsule for containing beverage ingredients, the capsule being designed for insertion in a beverage production device in which a liquid under pressure enters the capsule in order to interact with the ingredients in the capsule and to drain a beverage from the capsule. For this, the capsule comprise a sealing member on its the outer surface. The sealing member is geometrically arranged to be in sealing engagement with at least a matching pressing surface of the beverage production device. The capsule member comprises a body extending by a flange-like rim with the sealing member attached thereto. According to an aspect of the invention, the sealing member is pinched by the curled end of the flange-like rim of the capsule. Other aspects of the capsule can be found in relation to the method of the invention either as aforementioned or as will appear in greater detail in the following description of the embodiment.

DETAILED DESCRIPTION OF THE PREFERRED EMBODIMENTS

Figure 1:
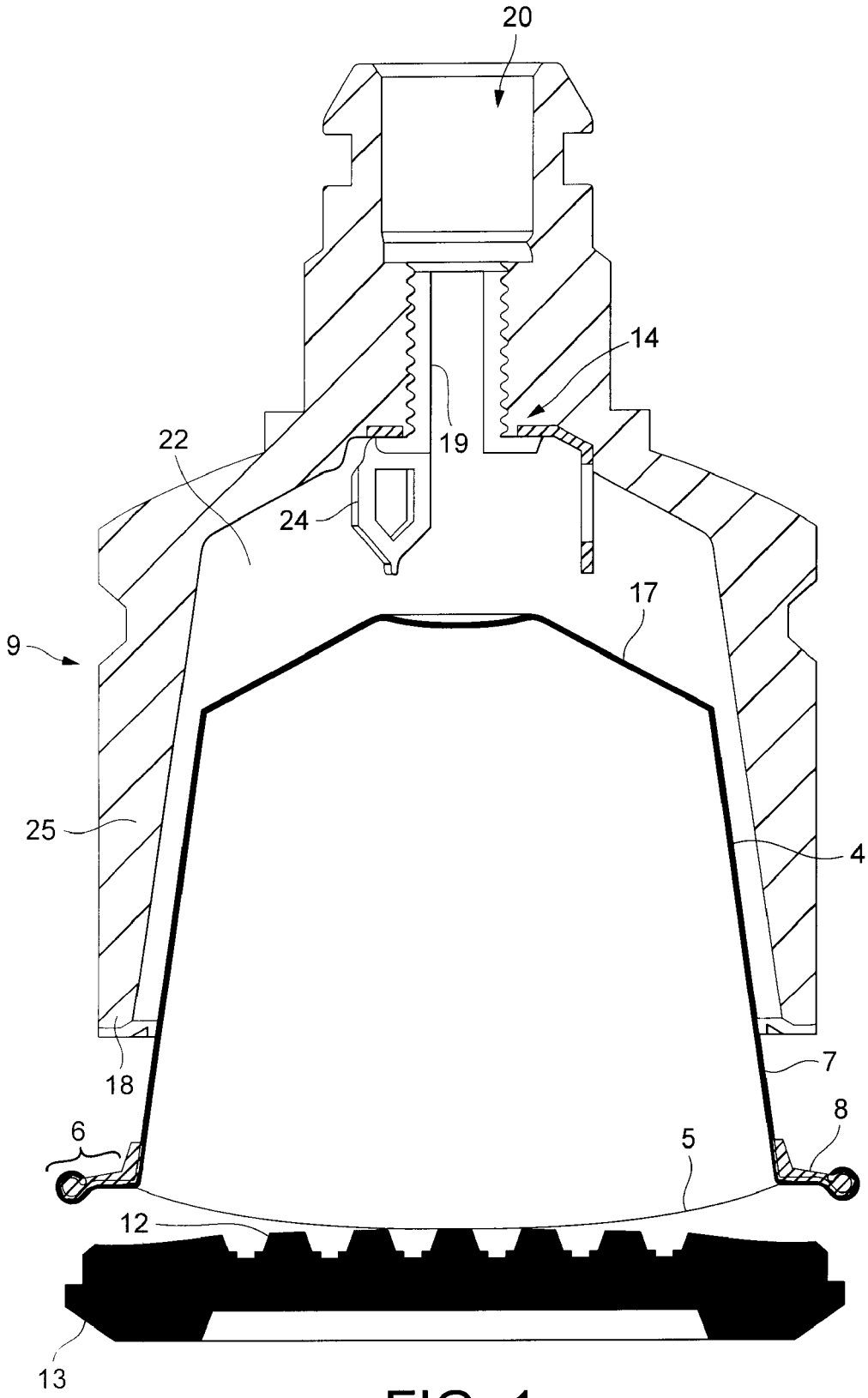
FIG. 1 shows a first embodiment of the capsule system of the present invention in which a capsule is placed on the capsule holder but has not yet reached its closing position in the beverage production device.

Note that in the following the invention will be explained referring to a certain design of a capsule, i.e. a design according to which the capsule comprises a cup-like base body and a closing foil member. However, it is to be understood than other designs of the capsule are viable, such as e.g. capsules having a lenticular form with two essentially matching and opposing walls (e.g. foils) being sealed at the e.g. ring-shaped edge. Generally a capsule according to the present invention comprises at least two opposing wall members (faces) which are connected to each other at their respective peripheral edges to form a sealed flange-like rim area, thus enclosing a sealed interior.

The embodiment shows a capsule holder 13 having relief elements 12 which are designed to tear and perforate a foil member 5 closing off a cup-like base body 4 of the capsule 1. This tearing of the foil member 5 can occur as soon as the pressure inside the capsule exceeds a threshold value. Note that the relief elements can have any protruding shape able to cause a controlled tearing of the foil member. As an example only pyramids, needles, bumps, cylinders, elongated ribs are cited. The relief element can also be a single needle or perforator.

FIG. 1 shows a state in which such a capsule has been placed on a capsule holder 13, the foil member 5 resting on the relief elements 12 of the capsule holder 13 and the cup-like base body 4 of the capsule 1 being already partly surrounded by the circumferential wall 25 of an enclosing member 9 of the beverage production device. The shown enclosing member can have the shape of a bell. Other shapes are viable, wherein the design of the interior contours (recess) of the enclosing member is generally adapted to substantially match the contours of the capsule 1.

The capsule holder 13 (also representing an enclosing member) and the enclosing member 9 thus can selectively enclose a capsule enclosure space 22 when transferred from an opened position into a capsule-enclosing position.

Note that the foil member 5 as shown is not necessarily exactly flat due to a defined over pressure inside the capsule, which over pressure is generated by introducing e.g. a protective gas when producing the filled capsule and by gas desorbing from the food ingredients after sealing, for instance, carbon dioxide from coffee. The enclosing (bell) member 9 furthermore comprises an annular pressing surface 18 and a water inlet opening 20 for feeding a liquid such as for example hot water under pressure to a water injection system 14 which is releasable mounted (e.g., screwed) to the bell member 9.

The water injection system can comprise one or more perforation elements (blades, pins, etc.) 24 designed to produce one or more openings in the top wall 17 of the capsule 1 when the capsule holder 13 and the bell member 9 are moved close together e.g. by a manually operated or an automatic closing mechanism. A channel 19 traverses the injection system and leads to the enclosure 22 of the enclosing member 9 such that water can be fed to the interior of the capsule 1 once the perforation elements 24 protrude into the interior of the capsule 1.

The capsule 1 comprises said top wall 17, a side wall 7 and a flange-like rim 6, wherein the foil member 5 is sealed to said flange-like rim 6 to close-off hermetically the cup-like base body 4 of the capsule 1. Again, other designs for the capsule are possible as long as the capsule can be sealed and contains the mentioned ingredients.

According to the present invention the outer surface of the capsule 1 presents a dedicated watertightness sealing member (made of sealing material) 8 thereafter called "sealing member". The sealing member 8 can be compressible, more preferably even resilient.

The material for the sealing member can be rubber-elastomer, rubber plastic, plastic or silicone.

If a resilient material is used for the sealing member 8, preferably rubber-elastic materials are used. The term "rubber-elastic" means any suitable material having rubber elasticity when compressed, including but not limited to elastomers, silicones, plastics, latex, balata or others. Preferred materials for the sealing member are: Thermoplastic elastomer (TPE) such as Santoprene™ commercialised by the company Exxon Mobil Chemical, silicone or EPDM (Ethylene Propylene Diene Monomer).

Figure 2:
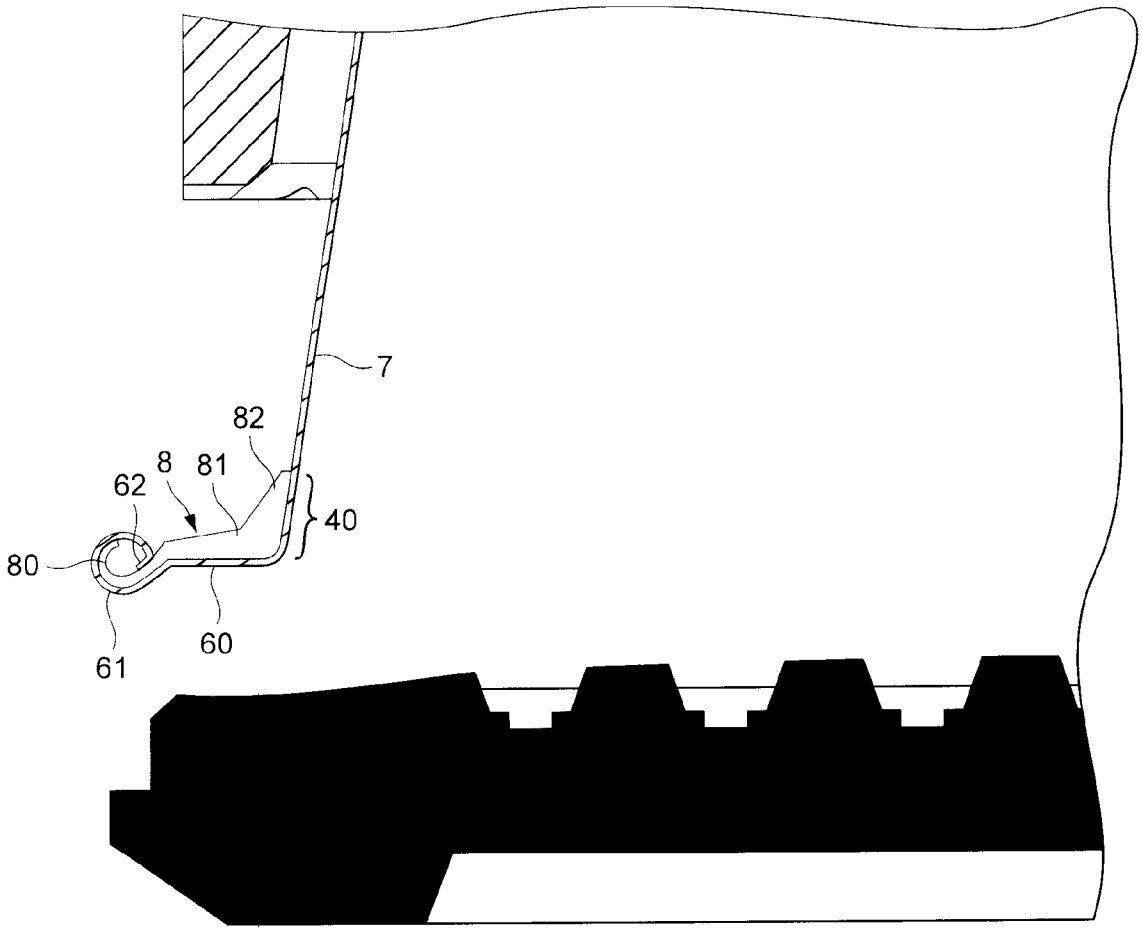
FIG. 2 shows an enlarged of FIG. 1, FIG. 3 the first embodiment in a state, in which a capsule has reached its closing position between the capsule enclosing parts, i.e., a bell member and the capsule holder.

As more apparent in FIG. 2, the capsule of the invention comprises a flange-like rim with a support portion 60 for the sealing member and a curled end portion 61 for being crimped and for pinching a part of the sealing member. The support portion 60 merges with the body 4 at a certain angle (i.e., slightly more than 90 degrees when the body has a truncated form). The flange like rim as well as the base surface 40 of the body receives the annular sealing member 8. In order for the sealing member to be affixed to the flange-like rim in a reliable manner, the sealing member extends toward the curled portion 61 by a connection portion 80 which is inserted and crimped by the crimping curled portion 61 of the rim. More particularly, in the illustrated example, the curled portion 61 terminates by a crimping end 62 which compresses and pinches the connection portion along an annular line or surface. Outside the curled portion 61, the sealing member extends along the support portion 60 of the flange-like rim by a sealing portion 81 that can extend upwards by a collar portion 82 applied against the base surface 40 of the body 4. The sealing portion 81 and collar portion 82 can form surfaces of different slopes or can merge in a single continuous concave or flat inclined surface. The form of the sealing member 8 into a wedge shape is chosen to provide a sufficient mass of material for compensating for the irregularities, gaps or other interstices between the capsule and the enclosing or bell member. As the watertight sealing may also be obtained dynamically, i.e., by effect of the water under pressure forcing on the sealing member, the shape, dimensions of the overall mass of the sealing member should be sufficient to deform, thus resiliably "flow" and fill correctly the left openings when the pressure builds up during brewing.

At the surfaces of contact between the sealing member 8 and the rim and/or base surface of the body could be applied an adhesive or welding. The adhesive or welding zone can cover partially or wholly the surfaces of contacts between the body and sealing member.

For instance, the crimping may have an effect to slightly pull outwardly on the sealing member which could result in leaving a gap at the junction between the collar portion 82 and the base surface 40. Although this gap can only affect appearance of the capsule, it does not affect the fluid-tight effect at the interface between the seal and the rest of the rim since such fluid-tightness is efficiently maintained at the crimping zone. An additional gluing or welding may thus serve to further improve these contact surfaces and eliminate or at least fill this gap.

Figure 3:
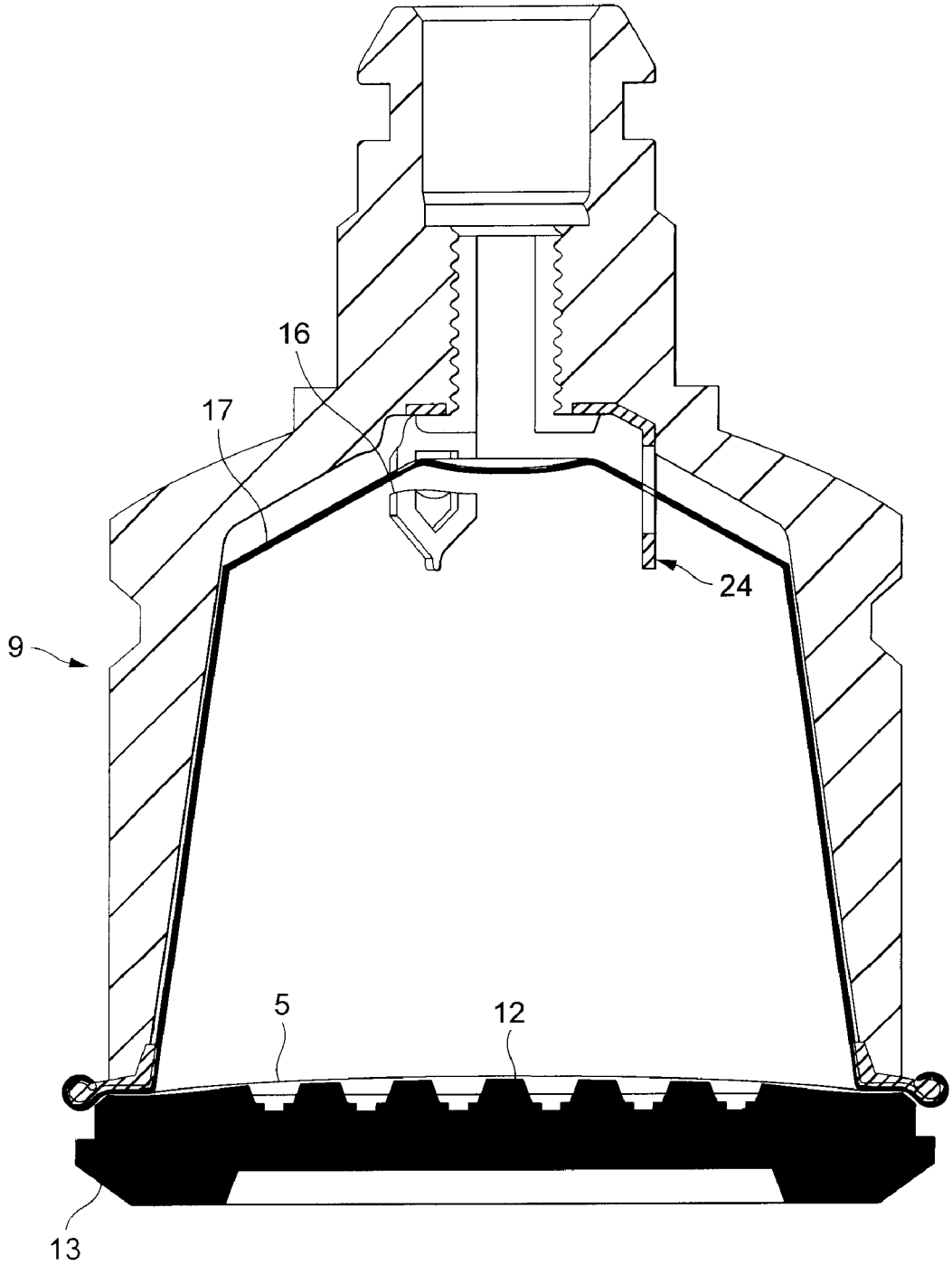
Figure 4:
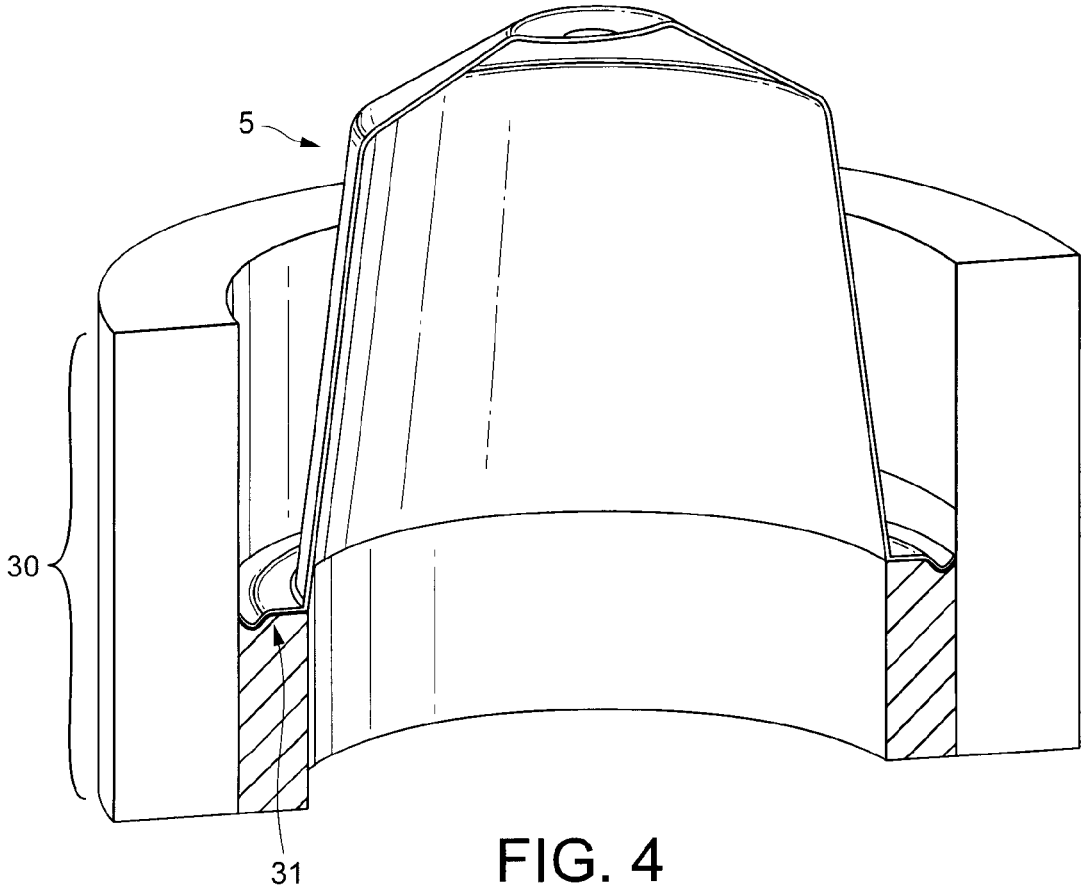
FIGS. 4 to 11 show different steps for applying the sealing member on the body of the capsule according to the method of the invention.

FIG. 3 shows the state in which the enclosing member 9 and the capsule holder 13 are brought in closing pressure engagement and due to the water entering the interior of the capsule and building up a pressure there the pyramidal relief members 12 of the capsule holder 13 produce openings in the foil member 5 of the capsule 1. Upon insertion of the capsule the blade elements 24 of the water injector 14 have created perforations 16 in the top wall 17 of the capsule 1. When a sufficient pressure of fluid has been built inside the capsule, the beverage produced from the ingredients contained in the capsule can be drained in small interstices or perforations created by tearing of the foil member 5 by the relief elements 12.

Steps of the method of the invention will now be described in connection with FIGS. 4 to 12. In a first step (not illustrated), the body 4 of the capsule is produced. The body is produced with a preform of the flange-like rim 6 which is not yet crimped but remains open for insertion and connection of the sealing member in a subsequent production step. The body 4 can be preformed by deep drawing of a metal sheet or an assembly of multiple plies including metal, e.g., aluminium and plastic, e.g., polypropylene, polyethylene or polylactic acid and eventually binders and/or lacquers. Depending on the complexity of the shape of the body and the depth of the cavity, the sheet can be deep drawn in more than a single step. Also, the main cavity of the body and the flange-like rim can be deep drawn in a same operation or, alternatively, in separate operations.

Figure 5:
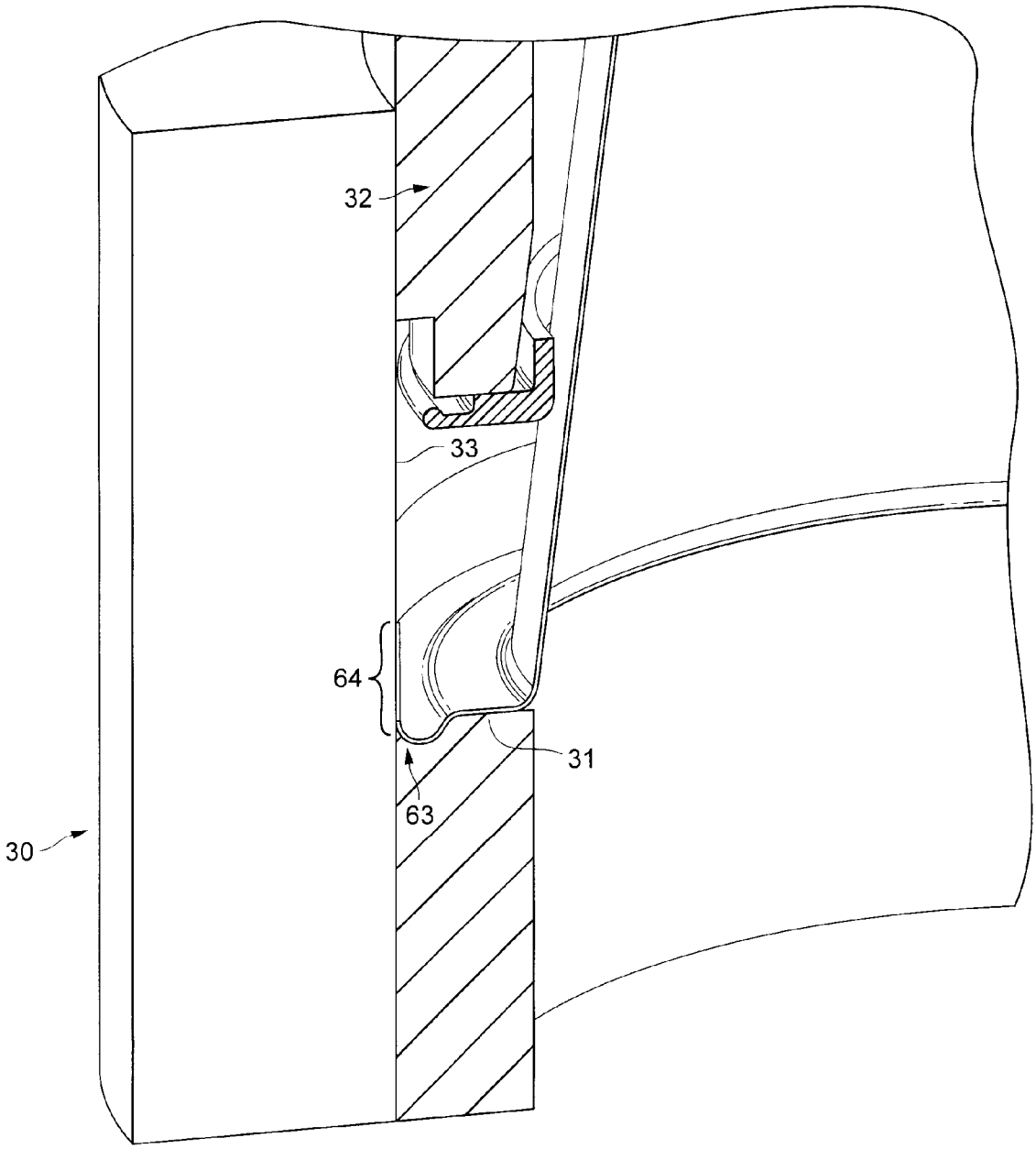

The preformed body can then be placed in a die 30 comprising an annular support surface 31 onto which the flange-like rim can be fixedly supported. FIG. 5 shows in detail the preform of the flange-like rim being held on the support surface 31 of the die 30. For instance, the flange-like rim as preformed can comprise a pre-curled end 63, i.e., a portion which is not entirely curled into a closed substantially toroidal form. The pre-curled is open upwardly and terminates by an upright formable flange portion 64 intended to be formed into the curled configuration. The flange portion 64 may be preformed straight or slightly curved.

Figure 6:
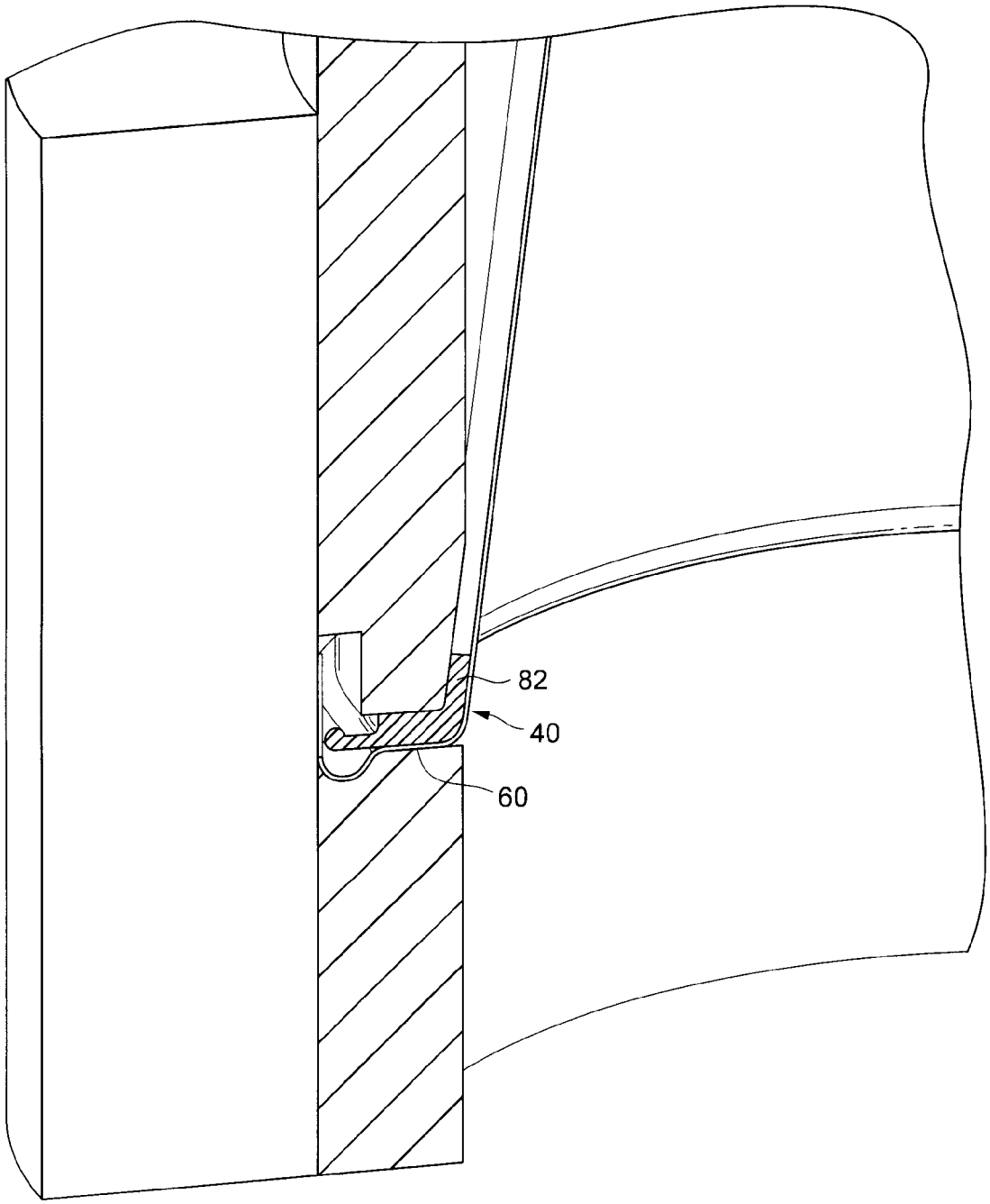

FIG. 5 also shows the sealing member which is inserted about the body of the capsule by a guiding mandrel 32 that slides downwardly along the inner surface 33 of the die. The sealing member can be pushed by the guiding mandrel 32 in a top-down effort until it comes in abutment against the support surface 60 of the flange-like rim as shown in FIG. 6. The guiding mandrel is shaped with sufficiently large surfaces which complement the sealing member to prevent the sealing member from twisting and for ensuring that the sealing member comes flat against the flange-like rim.

The contact surfaces of the sealing member and body may have been partially or wholly coated with an adhesive before insertion of the sealing member. In particular, an adhesive may be added at the interface between the upright portion 82 of seal and the base surface of the body 40 which is the critical part of the member that can be stretched after pinching the other end of the sealing member.

Figure 7:
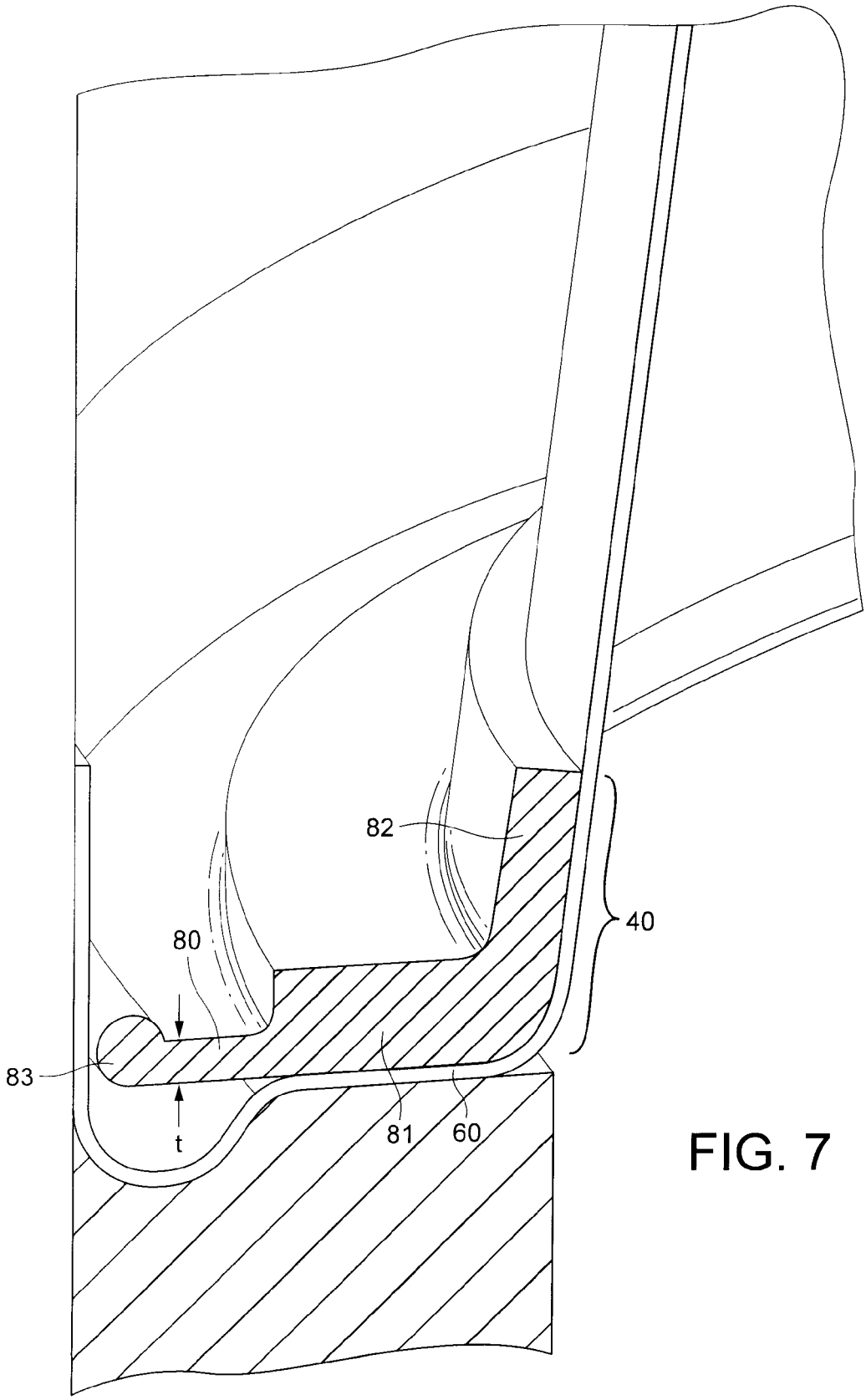
Figure 8:
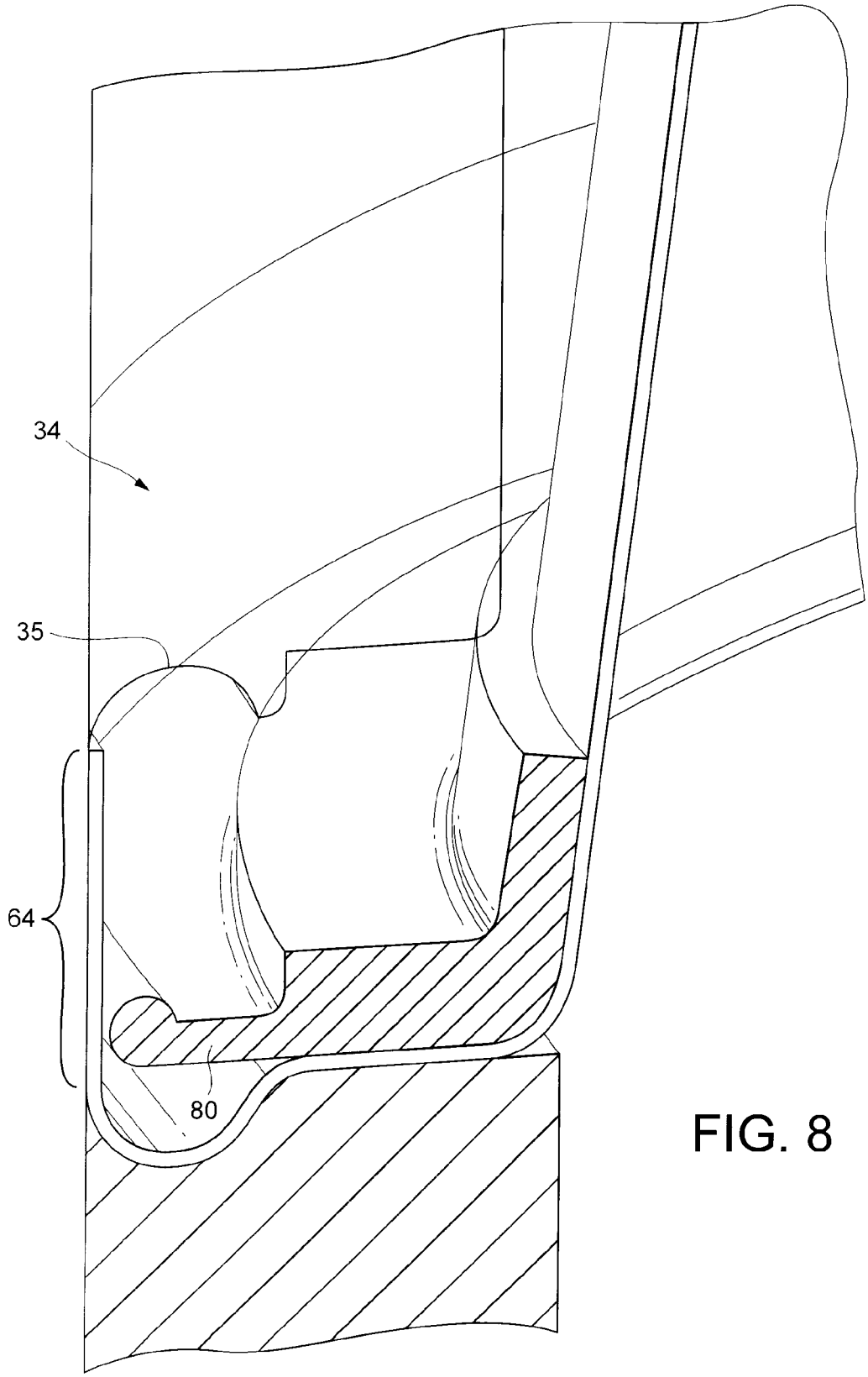

FIG. 7 shows in detail the arrangement of the sealing member and pre-curled flange-like rim after insertion of the sealing member in position on the rim. As clearly apparent, the sealing member extends radially by a connection portion 80 with a reduced thickness "t" compared to the portion that rests on the support portion 60 of the rim. This connection portion 80 of the sealing member is supposed to be the pinched portion by the flange-like rim. The connection portion 80 can extend at the crimping side by a terminal enlarged portion 83 which is not (or just slightly) compressed after crimping.

Figure 9:
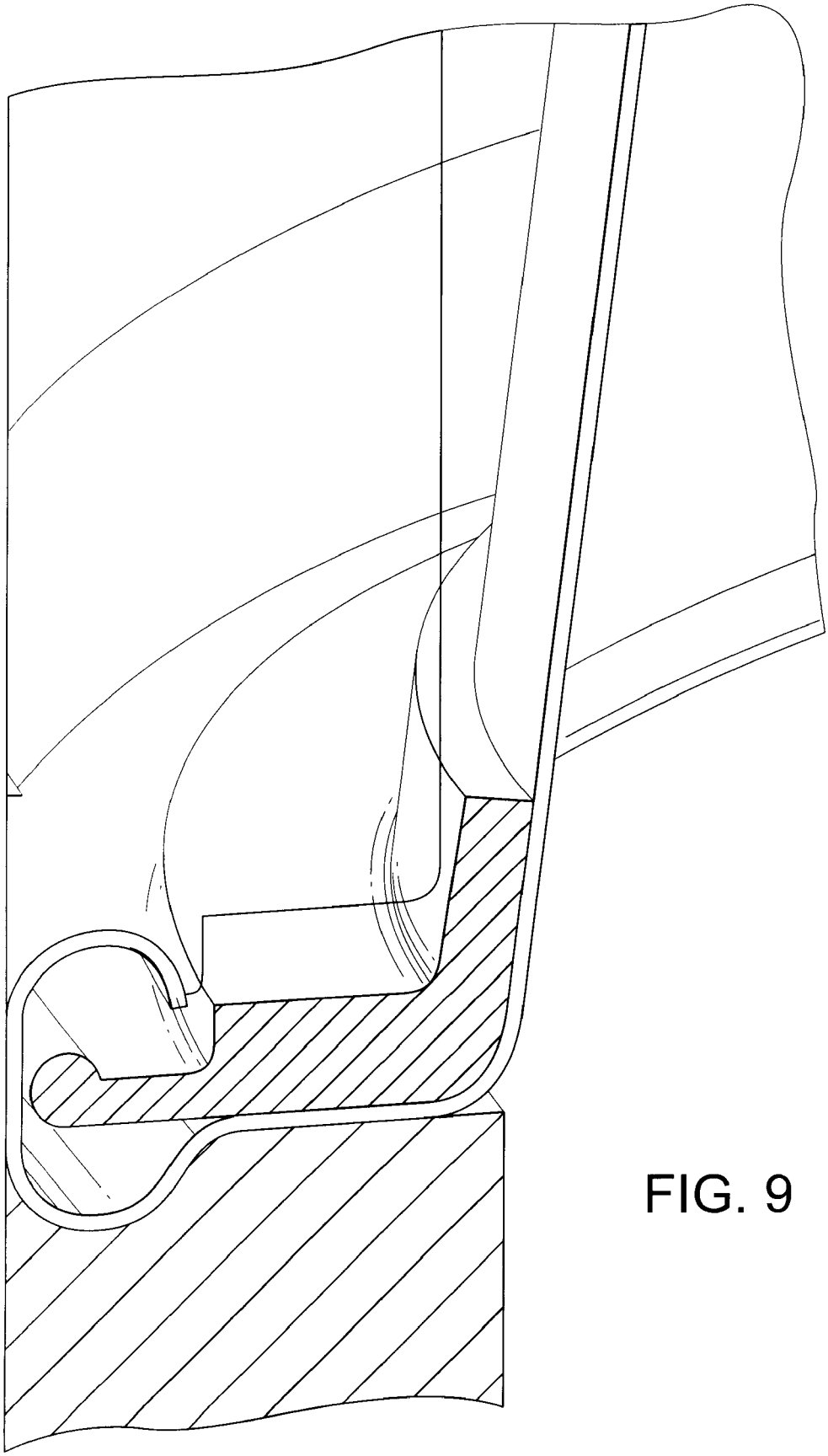
Figure 10:
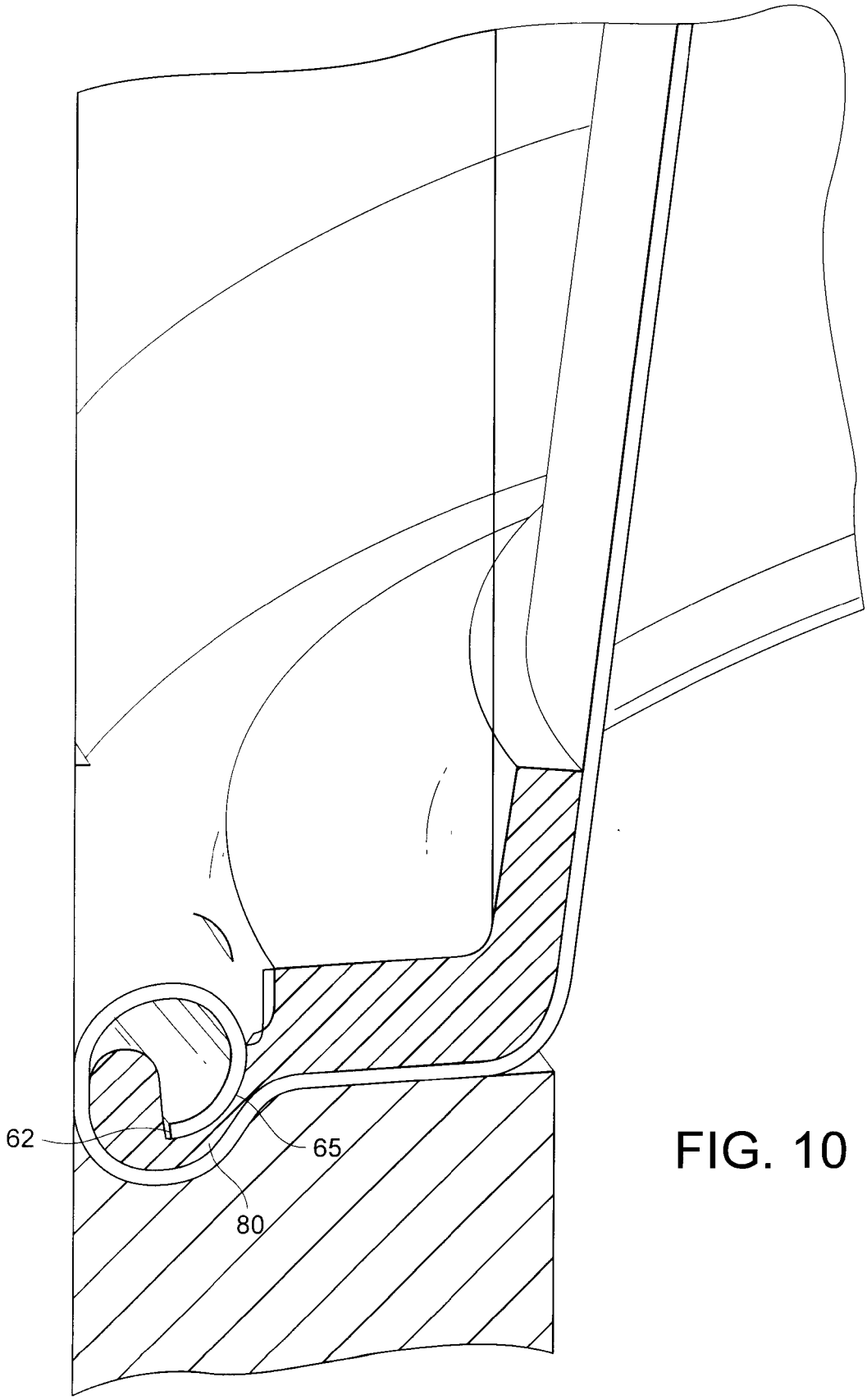
Figure 11:
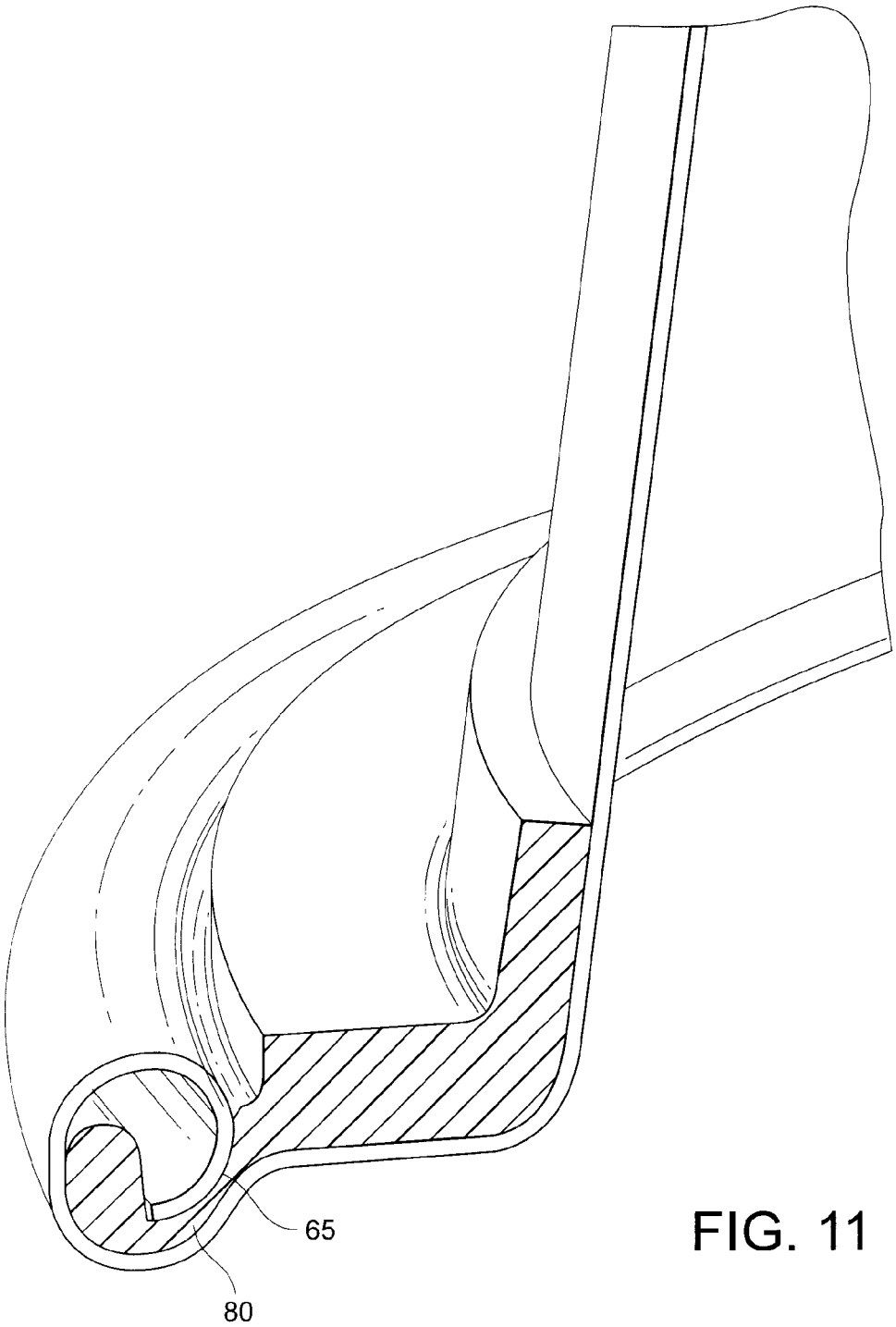

In the next step after proper insertion of the sealing member in position on the rim, a crimping mandrel 34 is activated that slides downwards along the die to pinch the formable flange portion 64. The crimping mandrel 34 generally has a substantially half-toroidal die surface 35 that engages the flange portion 64 in its descent toward the flange-like rim as is shown in FIG. 9. Due to the constant downward effort applied by the crimping mandrel on this end of the rim, the portion 64 rolls up and at its end 62 and/or terminal external surface 65, and it pinches the connection portion 80 of the sealing member. The connection portion 80 can also be slightly rolled up or simply slightly bent (depending on its length) and be so compressed and its thickness reduced to a degree of compression that depends on the final curled design and the portion's thickness as it is illustrated in FIG. 10. The crimped region 80, i.e., compressed region of the sealing member by the curled end of the rim, represents a sealing zone where the brewing liquid under high pressure (e.g., 10-20 bar) cannot pass. Therefore, a resulting liquid-tight arrangement is successfully obtained in this region between the flange-like rim and the sealing member (FIG. 11).

Figure 12:
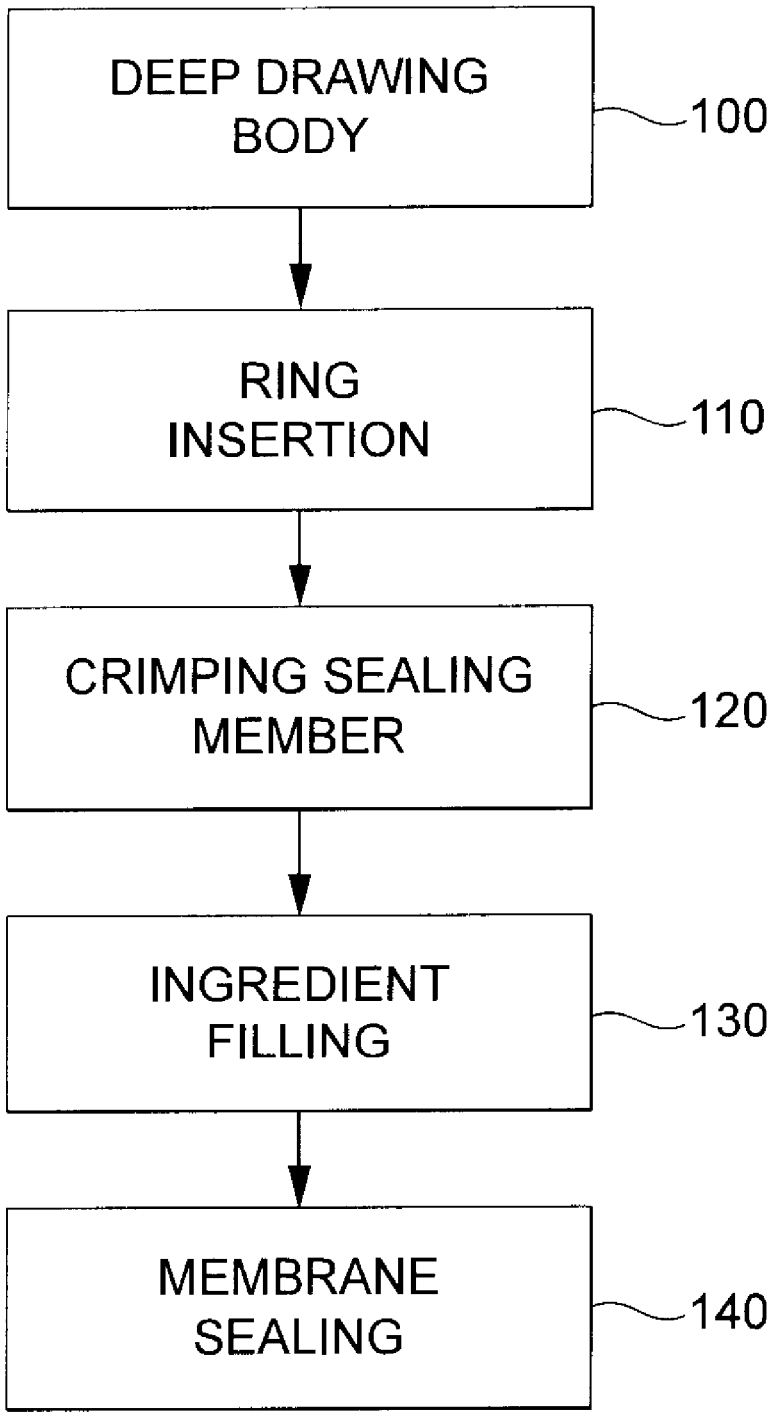
FIG. 12 is a chart illustrating steps of a mode of the invention.

As illustrated in FIG. 12, the method encompasses one or more steps 100 of deep drawing the capsule's body, a step of insertion 110 of the sealing member about the capsule's cup-like body and a step of crimping 120 of the flange-like rim to pinch and attach the sealing member on the capsule's body as just described in detail. In a next step 130, the body is filled with food ingredients and finally the membrane 5 is welded. e.g., by heat or ultrasonic welding, on the external face of support portion 60 of the flange-like rim. Additional steps can be envisaged at any suitable time during the production process such as positioning and affixing of filters inside the body and/or the membrane 5 before or after deep drawing of the body.

The crimping configuration according to the method of the invention may encompass various possible embodiments.

Figure 13:
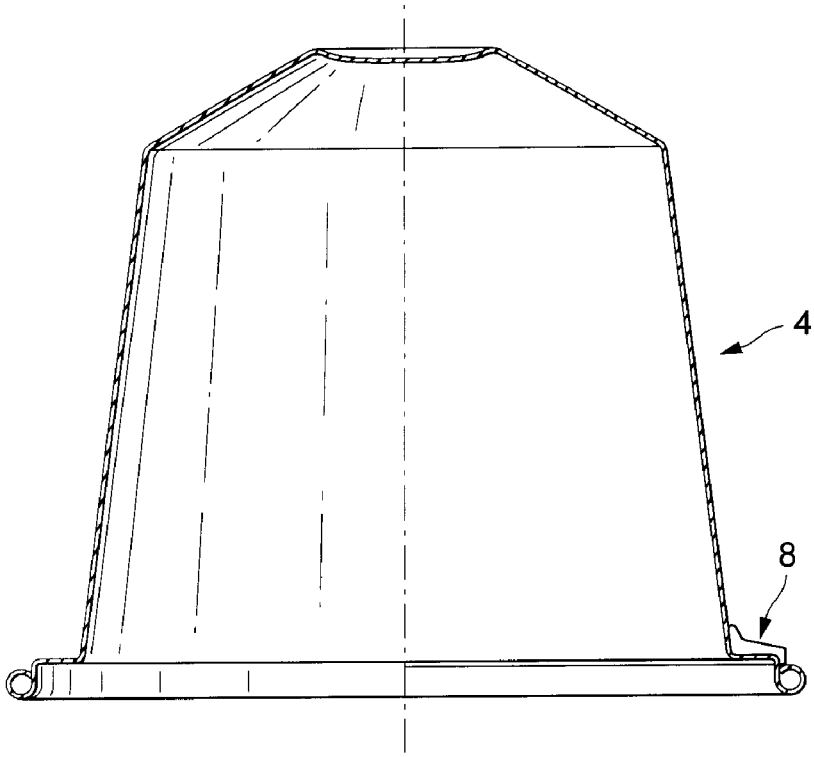
FIG. 13 shows a side view of the pre-formed capsule's body of the invention.
Figure 14:
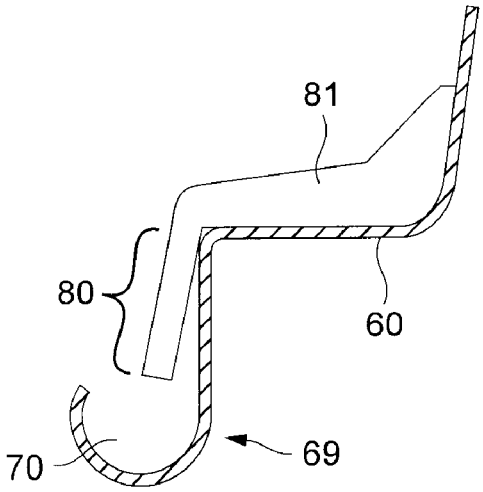
FIG. 14 is an enlarged view of FIG. 13 showing a detail of the configuration of the sealing member as positioned before final crimping.

FIGS. 13 and 14 show a possible mode in which, at rest, (i.e., after insertion but before crimping) the sealing member 8 is premade (i.e., moulded) with a connection portion 80 which is not aligned with the sealing portion 81 of the sealing member but inclined downwardly. The flange-like rim is similarly configured in its preform with a downwardly bent pre-curled portion 69 with an upwardly oriented opening 70. The portion 69 can make a folding angle of about 90 degrees (+/−15 degrees) with respect to the support portion 60 of the rim. The connection portion 80 of the sealing member is such that it substantially runs along the precurled portion 69 in the direction of opening 70. In this case, crimping is carried out by a crimping mandrel (not illustrated) acting in a bottom-up direction to straighten the curled portion up and close it around the connection portion 80 of the sealing member while pinching it sufficiently tight to create a fluid tight sealing arrangement. While the crimping mandrel is acting on the terminal portion of the flange-like rim, a counterforce (e.g., a static support surface of die) can be applied on the top surface of the sealing member to enable a proper crimping effect. In the final crimped configuration, the body of the capsule is as in the embodiment of FIGS. 1-3, with the most outward end part of the sealing member being slightly rolled up within the curled end of the rim.

Figure 15:
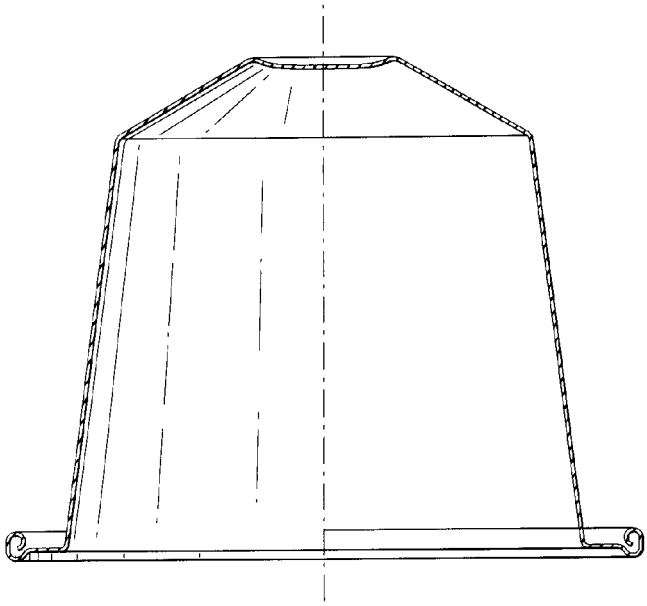
FIG. 15 shows a side view of the pre-formed capsule's body before insertion of the sealing member according to another variant of the invention.
Figure 16:
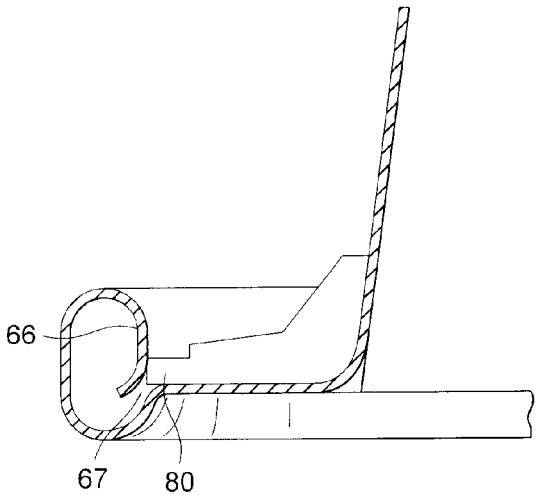
FIG. 16 is an enlarged view of FIG. 15 showing a detail of the configuration of the sealing member as positioned before final crimping.
Figure 17:
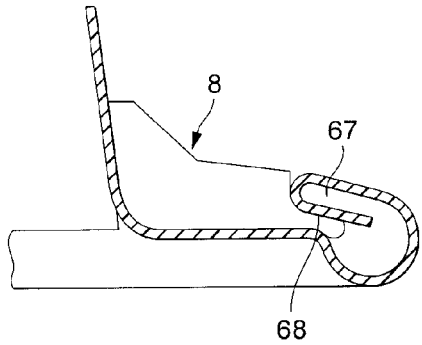
FIG. 17 is the enlarged view of FIG. 15 but after final crimping.

FIGS. 15 to 17 illustrate another possible variant in which the sealing member 8 has a shortened reduced thickness connection portion 80. The capsule's body is preformed with a curled end portion 66 while leaving or not an annular opening 67 oriented inwardly in direction of the end of the portion 80, e.g., abutting against its end. The form of the curled end portion 66 before the final crimping operation can be an elongated and closed or substantially closed torus. Such a shape provides once crimped on the sealing member a larger crimping surface. FIG. 16 shows the arrangement after the sealing member insertion but before final crimping operation. Crimping in FIG. 17 is carried out by pressing and so flattening the curled portion of flange 66 resulting in a flattened pinching portion of flange 67 that pinches with its external surface 68 the reduced thickness terminal portion 80 of the sealing member 8. Due to the closed end portion of the preformed body, i.e., of elongated toroidal shape, one advantage is that transport of the bodies from the deep drawing station to the crimping station is facilitated. In particular, transport of the bodies can be carried out pneumatically through guiding rails and therefore, the smoother rounded edges of the capsules are less prone to blocking or jamming the capsules in the pneumatic transport device. Another advantage is also linked to the ability to pile the bodies up for transport, storage or for doing buffer stocks in the factory.

What is claimed is:

1. A method for producing a capsule containing beverage ingredients designed for insertion in a beverage production device in which a liquid under pressure enters the capsule in order to interact with the ingredients in the capsule and to drain a beverage from the capsule, wherein the capsule comprises a body that includes a flange-like rim having a sealing member attached thereto; which method comprises:

pre-forming the capsule body and at least a portion of the flange-like rim, placing a premade sealing member on the flange-like rim, and crimping a portion of the flange-like rim on a portion of the sealing member to result in the sealing member becoming attached to the flange-like rim, wherein the crimping comprises forming a curled end at the flange-like rim arranged to pinch a portion of the sealing member.

2. The method according to claim 1, wherein the sealing member has a ring form.

3. The method according to claim 1, wherein the sealing member comprises a sealing portion and a connection portion extending outwardly from the sealing portion; wherein the connection portion is pinched by the curled end of the flange-like rim.

4. The method according to claim 3, wherein the section of the connection portion is made relatively thinner than the largest section of the sealing portion of the sealing member.

5. The method according to claim 3, wherein the sealing member is pre-made with the connection portion being inclined downwardly relative to the sealing portion and during crimping, the curled end is further curled to straighten the connection portion out, eventually roll it up, and pinch it tight.

6. The method according to claim 1, wherein, during preforming of the capsule body, an open curled end or substantially closed curled end is already pre-formed.

7. The method according to claim 6, wherein, during crimping, the curled end is further curled or at least pressed to at least partially enclose the connection portion and pinch it tight.

8. The method according to claim 1, wherein the sealing member is pre-made with a sealing portion and a connection portion being relatively aligned one another and during crimping the curled end is further curled or at least flattened to crimp the connection portion along an external surface of the curled end.

9. The method according to claim 1, wherein the flange-like rim is folded and the sealing member is pinched by the outer surface of the folded flange-like rim.

10. The method according to claim 1, wherein the capsule body is pre-formed by deep drawing of a metal sheet or metal-plastic laminate.

11. The method according to claim 1, which further comprises gluing or welding the sealing member to the flange-like rim.

12. The method according to claim 1, which further comprises filling the body with the food ingredient, wherein the body is made of aluminum.

13. The method according to claim 1, which further comprises welding a membrane along a portion of the external face of the flange-like rim to close the capsule.

14. The method according to claim 1, wherein the sealing member is made of a resilient material selected from the group consisting of rubber, plastic and silicone material.

15. A method for producing a capsule containing beverage ingredients designed for insertion in a beverage production device in which a liquid under pressure enters the capsule in order to interact with the ingredients in the capsule and to drain a beverage from the capsule, wherein the capsule comprises a body that includes a flange-like rim having a sealing member attached thereto; which method comprises:

pre-forming the capsule body and at least a portion of the flange-like rim, placing a premade sealing member on the flange-like rim, wherein the sealing member further comprises an annular collar portion that extends beyond the rim along the base surface of the capsule body, and crimping a portion of the flange-like rim on a portion of the sealing member to result in the sealing member becoming attached to the flange-like rim.

16. A capsule for containing beverage ingredients, the capsule being designed for insertion in a beverage production device in which a liquid under pressure enters the capsule in order to interact with the ingredients in the capsule and to drain a beverage from the capsule, the capsule comprising a sealing member on the outer surface of the capsule, the sealing member being geometrically arranged to be in sealing engagement with at least a matching pressing surface of the beverage production device during beverage preparation, wherein the capsule comprises a body that includes a flange-like rim having a sealing member attached thereto, and the sealing member is pinched by the flange-like rim of the capsule to be secured to the body, wherein the sealing member comprises a connection portion which is pinched by a curled end of the flange-like rim.

17. The capsule according to claim 16, wherein the sealing member is of resilient material selected from the group consisting of rubber, plastic and silicone material.

18. The capsule according to claim 16, wherein the capsule has an aluminum or plastic-aluminum deep-drawn body that is hermetically closed by a membrane sealed on the outer surface of the rim of the capsule body.

* * * * *